United States Patent [19]

Vainshtein et al.

[11] Patent Number: 4,947,813

[45] Date of Patent: Aug. 14, 1990

[54] METHOD FOR CONTROLLING THE ROTATIONAL SPEED OF A THERMAL ENGINE

[76] Inventors: Grigory Y. Vainshtein, Volkovsky prospekt, 110, kv. 65; Anatoly V. Kozlon, 12-ya Krasnoarmeiskaya ulitsa, 21, kv. 23, both of Leningrad; Vladimir I. Marakin, Novosibirsky raion, poselok Krasnoobsk, 49, kv. 6, Novosibirskaya oblast; Jury F. Khaimin, Volkovsky prospekt 110, kv. 106, Leningrad, all of U.S.S.R.

[21] Appl. No.: 302,599

[22] PCT Filed: May 14, 1987

[86] PCT No.: PCT/SU87/00056

§ 371 Date: Jan. 13, 1989

§ 102(e) Date: Jan. 13, 1989

[87] PCT Pub. No.: WO88/08924

PCT Pub. Date: Nov. 17, 1988

[51] Int. Cl.[5] ..... F02D 11/10

[52] U.S. Cl. ..... 123/352; 123/357; 123/361

[58] Field of Search ..... 123/339, 352–356, 123/357, 361, 399

[56] References Cited

U.S. PATENT DOCUMENTS

| | | | |
|---|---|---|---|
| 2,987,054 | 6/1961 | Eddy | 123/376 |
| 4,572,131 | 2/1986 | Hashimoto | 123/357 |
| 4,727,840 | 3/1988 | Mishida et al. | 123/361 X |
| 4,759,184 | 7/1988 | Kita | 123/396 X |

FOREIGN PATENT DOCUMENTS

| | | |
|---|---|---|
| 217218 | 4/1968 | U.S.S.R. . |
| 708065 | 1/1980 | U.S.S.R. . |
| 1544246 | 4/1979 | United Kingdom . |

*Primary Examiner*—Tony M. Argenbright
*Attorney, Agent, or Firm*—Lilling & Greenspan

[57] ABSTRACT

A method for controlling the rotational speed of a thermal engine residing in that a speed of rotation of the theraml engine is preset, a control signal based on this speed is shaped to control the speed of rotation of an electric motor according to the rotational speed of one of the input shafts of a differential mechanism kinematically linked with the electric motor and thermal engine fuel metering member is kinematically linked with an output shaft of the differential mechanism, and a correction signal is simultaneously shaped for the speed of rotation of the electric motor at transient operating conditions on the basis of the speed of rotation of the output shaft of the differential mechanism.

2 Claims, 1 Drawing Sheet

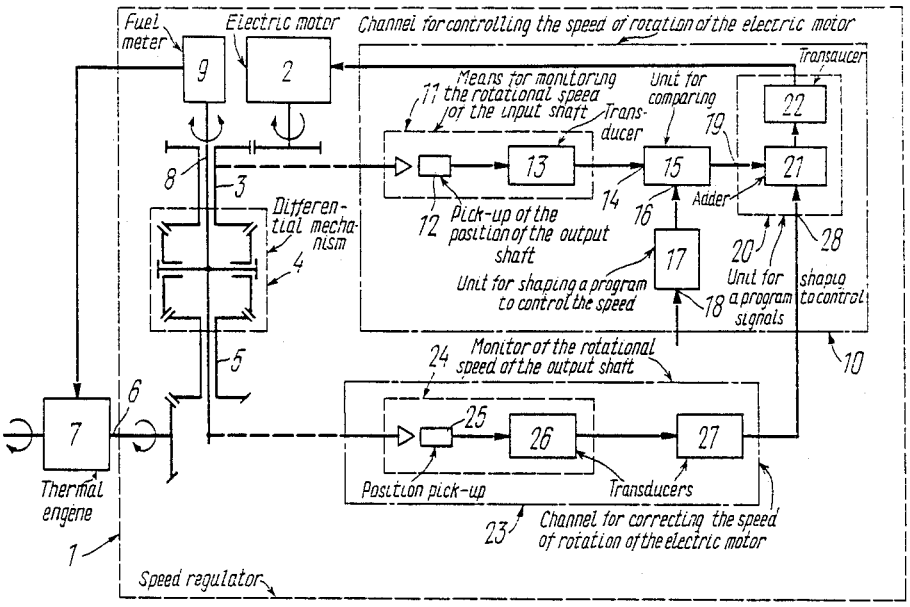

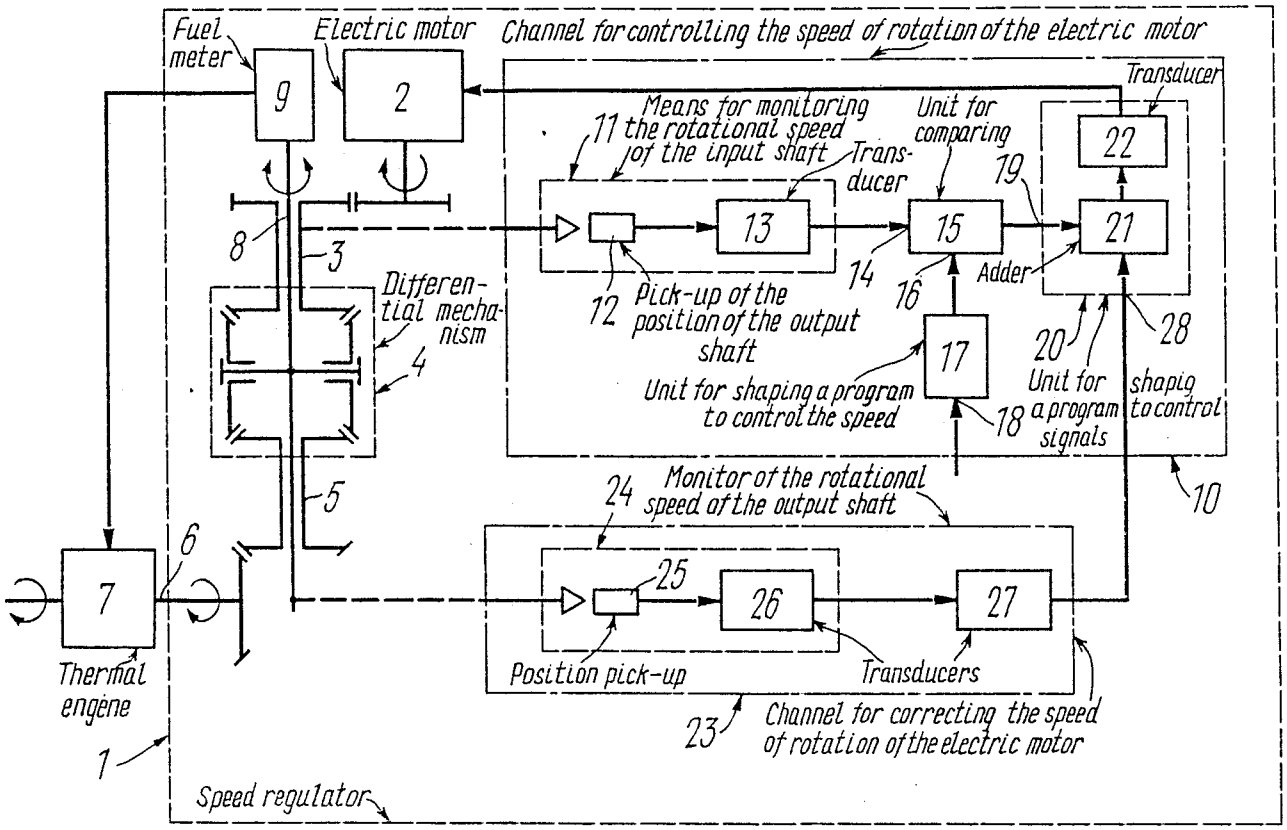
Channel for controlling the speed of rotation of the electric motor
Transducer
22
21
28
10
Unit for shaping a program signals to control
20
18
Adder
19
Unit for comparing
15
17
16
14
Means for monitoring the rotational speed of the input shaft
Trans-ducer
13
Pick-up of the position of the output shaft
12
11
Unit for shaping a program to control the speed
Monitor of the rotational speed of the output shaft
24
27
Transducers
26
25
Position pick-up
23
Channel for correcting the speed of rotation of the electric motor
Electric motor
2
Differen-tial mecha-nism
4
3
5
Fuel meter
9
8
6
7
Thermal engene
1
Speed regulator

METHOD FOR CONTROLLING THE ROTATIONAL SPEED OF A THERMAL ENGINE

BACKGROUND OF THE INVENTION

1. Field of the Invention

This invention relates to thermal engines and, more particularly, to a method for controlling the speed of rotation of a thermal engine.

2. Description of the Prior Art

Among major performance characteristics of a machine equipped with a thermal engine are: reliability, capacity, fuel efficiency, ability to perform process operations, the amount of fumes and toxicity of exhaust gases at transient operating conditions, and other ratings. To a substantial extent these ratings depend on the manner in which the rotational speed of the thermal engine is controlled at transient operating conditions, particularly those involving overcontrol and duration of the transient process.

There is known a method for controlling the rotational speed of a thermal engine embodied in a speed governor described in SU, A, 217,218. In this method a signal is shaped for controlling the speed of rotation of an electric motor energized by a current source connected to a control circuit of the electric motor, and a correction signal is formed for correcting the rotational speed of the electric motor at transient operating conditions proportional to the deviation in the position of the outlet shaft of the differential mechanism which is kinematically linked with the fuel meter of the thermal engine. A feedback potentiometer secured at the speed control lever ensures inclination of the control characteristic of the speed of rotation of the thermal engine.

Shaping a control signal in the form of a rigid feedback, involving the differential mechanism and electric motor, imparts to the control characteristic a static feature normally improving the control over the rotational speed of the thermal engine. However, at inclinations of the control characteristic of the thermal engine normally not exceeding 6–8% of the rated rotational speed of the thermal engine, highly efficient control over the speed of rotation of the thermal engine is not ensured.

There is also known a method for controlling the speed of rotation of a thermal engine materialized in a speed regulator disclosed in Su, A, 708,065. In this method the speed of rotation is preset, a control signal corresponding to this speed is shaped for controlling the rotational speed of an electric motor based on the speed of rotation of one of the input shafts of the differential mechanisms kinematically linked with the electric motor and with the thermal engine whose fuel meter is kinematically linked with the output shaft of the differential mechanism, and simultaneously a correction signal is shaped for correcting the rotational speed of the electric motor at transient operating conditions.

The correction signal is shaped to be proportional to the derivative of the speed of rotation of the input shaft of the differential mechanism which is kinematically linked with the thermal engine.

As compared with the method previously described, this prior art method affords a higher stability and efficiency of speed controlling, such as overcontrol magnitude and duration of the transient operation period, through shaping a correction signal in the form of a derivative of the speed of rotation of the thermal engine. However, when shaping the correction signal as a derivative of the speed of rotation, this signal fails to follow deviation in the speed of rotation of the thermal engine in the course of controlling, whereby high speed-control efficiency cannot be attained.

SUMMARY OF THE INVENTION

This invention is therefore aimed at providing a method for controlling the speed of rotation of a thermal engine in which a signal for correcting the rotational speed of an electric motor at transient operating conditions is shaped according to such a parameter which would improve such characteristics as speed-control efficiency, overcontrol magnitude, and duration of the transition period.

The aim of the invention is attained by a method for controlling the rotational speed of a thermal engine wherein a rotational speed of the thermal engine is preset, a control signal based on this speed is shaped to control the speed of rotation of an electric motor according to the rotational speed of one of the input shafts of a differential mechanism kinematically linked with the electric motor and thermal engine, a fuel meter of which is kinematically linked with an output shaft of the differential mechanism, and a correction signal is simultaneously shaped for correcting the speed of rotation of the electric motor at transient operation conditions. According to the invention, the correction signal for correcting the speed of rotation of the electric motor at transient operating conditions is shaped on the basis of the speed of rotation of the output shaft of the differential mechanism.

Preferably, the correction signal for correcting the speed of rotation of the electric motor at transient operating conditions is shaped to be proportional to the speed of rotation of the output shaft of the differential mechanism.

Shaping the correction signal on the basis of the speed of rotation of the output shaft of the differential mechanism by the proposed method ensures shaping a control signal for controlling the speed of rotation of the electric motor in accordance with disagreement between the rotational speeds of the input shafts of the differential mechanism to result in improvement of such control characteristics as magnitude of overcontrol and duration of the transient period.

BRIEF DESCRIPTION OF THE DRAWINGS

The invention will now be described in greater detail exemplified by a specific embodiment of a rotational speed regulator taken with reference to the accompanying drawings the sole FIGURE of which illustrates a functional diagram of such a regulator.

DESCRIPTION OF THE PREFERRED EMBODIMENT

A method for controlling the speed of rotation of a thermal engine is carried out by a known speed regulator. The regulator 1 comprises an electric motor 2 connected to an input shaft 3 of a differential mechanism 4. Another input shaft 5 of this mechanism 4 is operatively connected to a shaft 6 of the thermal engine 7. An output shaft 8 of the differential mechanism 4 is operatively connected to a fuel meter 9 of the thermal engine 7. Operative connections of the differential mechanism are shown in the FIGURE in the form of gear transmissions.

The regulator 1 also includes a channel 10 for controlling the speed of rotation of the electric motor. Provided at the inlet to the channel 10 is a means 11 for monitoring the rotational speed of the input shaft of the differential mechanism, in the embodiment herein described comprising a position pick-up 12 of the position of the output shaft 8 of the differential mechanism 4 having connected to its outlet a transducer 13 for converting variations in the position of the output shaft 8 to an electric signal proportional to the speed of rotation of the input shaft 3.

The output of the transducer 13 is connected to input 14 of a comparator unit 15 for comparing the current speed of rotation of the output shaft 8 of the differential mechanism 4 with the preset speed of rotation. The input 16 of the comparator unit 15 is connected to the output of a unit 17 for shaping a program to control the speed of rotation of the electric motor having an input 18 to set the speed of rotation of the thermal engine 7. The output of the comparator unit 15 is connected to a control input 19 of a unit 20 for shaping a control signal, said control input 19 being the first input of an adder 21. The output of the adder 21 is connected to the input of a transducer 22 of an electrical signal to a frequency of synchronizing pulses whose output serves as the output of the unit 20 for shaping the control signals and is connected to the electric motor 2.

The regulator 1 also has a channel 23 for correcting the speed of rotation of the electric motor at transient conditions in response to the speed of rotation of the output shaft 8 of the differential mechanism 4. This channel 23 has a monitor 24 of the rotational speed of the output shaft 8 of the differential mechanism 4 in the form of a position pick-up 25 having connected to its output a transducer 26 for monitoring the variations in the position of the output shaft and converting it to a signal proportional to its speed of rotation. The output of the transducer 26 is connected to the input of an electrical signal transducer 27 whose output serves as the output of the correction channel 23, and is connected to a correction input 28 of the unit 20 for shaping the control signal, the second input of the adder 21 serving as the input 28.

The transducer 27 is intended to bring the signal at the correction input 28 of the unit 20 for shaping the control signal into agreement with the signal at its control input 19.

The proposed method for controlling the speed of rotation of a thermal engine is carried out in the following manner. The speed of rotation of the thermal engine 7 is preset. With this aim in view, information on the temperature of the outside medium and atmospheric pressure necessary for ensuring good starting characteristics of the engine, as well as on the pressure of oil in the engine, temperature of exhaust gases for ensuring duly stop of the engine, etc. is fed in the form of a signal through the input 18 to the unit 17 for shaping the engine rotation control program. The unit 17 shapes the program so that it is executed in accordance with the preset operating conditions of the thermal engine 7.

The input shaft 3 of the differential mechanism 4 is rotated by the electric motor 2 at a speed proportional to the electric signal at the output of the unit 17. A signal for controlling the speed of rotation of the electric motor is shaped in accordance with the preset speed of rotation of the thermal engine 7 on the basis of the rotational speed of one of the input shafts of the differential mechanism 4, particularly the input shaft 3. The signal for controlling the speed of rotation of the electric motor 2 is shaped in the comparator unit 15, the input 14 of this unit 15 receiving a signal from the means 11 for monitoring the rotational speed of the input shaft 3 of the differential mechanism, the input 16 receiving a signal from the unit 17 for shaping the program to control the speed of rotation of the electric motor. The signal at the output of the comparator unit 15 serves as a signal for controlling the speed of rotation of the electric motor 2 at steady state condition and, passing through the transducer 22 is an electrical signal of the frequency of synchronizing pulses to be delivered to the electric motor 2.

The input shaft 5 is rotated from the shaft 6 of the thermal engine 7 in a direction counter to the rotation of the shaft 3. With an equality of rotational speeds of the input shafts 3 and 5 due to the invariable signal at the input 18 of the program shaping unit 17 for controlling the rotational speed of the electric motor and continuity in the load of the thermal engine, the output shaft 8 of the differential mechanism 4 and the fuel meter 9 connected thereto are stationary.

Variations in the load of the thermal engine 7 or a change in the signal at the input 18 of the program shaping unit 17 characterizing the transient process of adjustment lead to respective variations in the speed of rotation of the shaft 3 or shaft 5, whereby due to a difference in the rotational speeds of the shafts 3, 5 the output shaft 8 starts to rotate accompanied by the movement of the fuel meter 9 thereby compensating for disagreement between the rotational speeds of the shafts 3, 5 by changing the fuel feed. Simultaneously with generation of the signal controlling the speed of rotation of the input shaft 3 a correction signal is shaped to correct the rotational speed of the electric motor 2 at transient conditions based on the speed of rotation of the output shaft 8 of the differential mechanism 4, particularly to be proportional to this speed of rotation. The pick up 25 generates an electrical signal proportional to the speed of rotation of the output shaft 8, which is brought in agreement by the transducer 27 with the electrical signal at the control input 19 of the unit 20 for shaping the control signal, and is delivered to the correction input 28 of the unit 20. The control signal summarized in the adder 21 with the signal controlling the rotational speed of the electric motor 2 and converted to the frequency of synchronizing pulses by the transducer 22 is delivered to the electric motor 2. Therefore, the control signal of the rotational speed of the electric motor 2 obtained at the output from the transducer 22 acts to establish such a speed of the electric motor 2 at which the difference between the rotational speeds of the input shafts 3 and 5 is zero, whereby the thermal engine 7 is brought to steady state operating conditions.

In view of the aforedescribed, with an increase in the load of the thermal engine 7 its rotational speed reduces, disagreement between the speeds of rotation of the input shafts 3, 5 takes place due to reduced rotational speed of the shaft 5, and a correction signal appears causing reduction in the speed of rotation of the electric motor 2.

As the load of the thermal engine 7 reduces, the correction signal acts to increase the speed of rotation of the electric motor 2.

An increase in the signal at the input 18 of the program shaping unit 17 causes a higher rate of rotation of the electric motor 2 to result in disagreement between the rotational speeds of the input shafts 3, 5 due to a higher rotational speed of the shaft 3, whereby a correction signal appears to reduce the speed of rotation of the electric motor 2.

Weakening of the signal at the input 18 of the program shaping unit 17 causes the correction signal to increase the speed of rotation of the electric motor 2.

In the proposed method for controlling the speed of rotation of a thermal engine, shaping a correction signal on the bases of rotation of the output shaft 8 of the differential mechanism 4, particularly in proportion to this rotation, allows a signal for controlling the rotational speed of the electric motor 2 to be shaped in accordance with disagreement between the speeds of rotation of the input shafts 3, 5 of the differential mechanism 4, which results in reduced time of transition period and reduces the magnitude of readjustment in the rotational speed of the thermal engine 7.

The invention can be used in the power engineering industry for controlling the rotational speed of internal combustion engines, predominantly those employed in farm machines, combine harvesters, automobiles, diesel-electric and turboelectric power plants, stationary power generating units, industrial tractors, road construction machines and vehicles, as well as machines with other types of thermal engines, such as turbines.

We claim:

1. A method for controlling the rotational speed of a thermal engine comprising the following steps: presetting the rotational speed of said thermal engine; shaping a control signal based on the rotational speed of said thermal engine to control a speed of rotation of an electric motor, said control signal being shaped according to a rotational speed of an input shaft of a differential mechanism kinematically linked with said electric motor and said thermal engine, said thermal engine having a fuel metering member kinematically linked with an output shaft of the differential mechanism; and simultaneously shaping a correction signal for the speed of rotation of the electric motor at transient operating conditions, said correction signal for said rotational speed of the electric motor at transient operating conditions being shaped on the basis of the speed of rotation of the output shaft of the differential mechanism.

2. A method for controlling the rotational speed of a thermal engine as claimed in claim 1, wherein the correction signal for the speed of rotation of the electric motor at transient operating conditions is shaped to be proportional to the speed of rotation of the output shaft of the said differential mechanism.

* * * * *